US008006923B2

(12) United States Patent
Stoops

(10) Patent No.: US 8,006,923 B2
(45) Date of Patent: Aug. 30, 2011

(54) SMOOTH BORE NOZZLE WITH ADJUSTABLE BORE

(75) Inventor: Kyle Alden Stoops, Elkhart, IN (US)

(73) Assignee: Elkhart Brass Manufacturing Company, Inc., Elkhart, IN (US)

( * ) Notice: Subject to any disclaimer, the term of this patent is extended or adjusted under 35 U.S.C. 154(b) by 59 days.

(21) Appl. No.: 12/332,695

(22) Filed: Dec. 11, 2008

(65) Prior Publication Data

US 2009/0152373 A1 Jun. 18, 2009

Related U.S. Application Data

(60) Provisional application No. 61/013,112, filed on Dec. 12, 2007.

(51) Int. Cl.
*B05B 1/32* (2006.01)

(52) U.S. Cl. ..... 239/451; 169/88

(58) Field of Classification Search ..... 251/4, 5, 251/8; 169/88; 239/451, 452, 455, 458, 239/456, 437, 439, 546, DIG. 12, 533.13
See application file for complete search history.

(56) References Cited

U.S. PATENT DOCUMENTS

| | | | |
|---|---|---|---|
| 22,819 | A | 2/1859 | Parrott et al. |
| 186,310 | A | 1/1877 | Curtis |
| 351,968 | A | 11/1886 | Derrick |
| 583,135 | A | 5/1897 | Wilson |
| 690,754 | A | 1/1902 | McKechney |
| 851,603 | A | 4/1907 | Long |
| 930,095 | A | 8/1909 | Seagrave |
| 1,004,770 | A | 10/1911 | Galloway |
| 1,040,899 | A | 10/1912 | Dahmen |
| 1,072,951 | A | 9/1913 | Johnston |
| 1,865,012 | A | 6/1932 | Jackson |
| 2,303,992 | A | 12/1942 | Frazer et al. |
| 2,569,996 | A | 10/1951 | Kollsman |
| 2,585,509 | A | 2/1952 | Smith |
| 2,959,359 | A | 11/1960 | Casaletto |
| 3,018,792 | A | 1/1962 | Brucker |
| 3,301,492 | A | 1/1967 | Kingsley |
| 3,684,192 | A | 8/1972 | McMillan |
| 3,776,470 | A | 12/1973 | Tsuchiya |

(Continued)

OTHER PUBLICATIONS

PCT International Search Report mailed Jul. 27, 2009, for corresponding PCT International Application No. PCT/US2008/086325.

*Primary Examiner* — Davis Hwu
(74) *Attorney, Agent, or Firm* — Baker & Daniels LLP

(57) ABSTRACT

A firefighting nozzle of the present invention includes a nozzle body with an inlet and an outlet, a passageway having a smooth bore extending between the inlet and the outlet of the nozzle body, and a compressible member defining at least a portion of the passageway. The compressible member has an inner dimension transverse to the longitudinal central axis. The nozzle also includes an adjuster mounted about the compressible member for selectively compressing the compressible member, wherein the pressure of the fluid flowing into the nozzle applies an outwardly directed pressure on the compressible member to thereby increase the inner dimension of the compressible member, and with at least a portion of the pressure being diverted from the passageway for applying an inwardly directed pressure on the compressible member to thereby at least reduce the force needed to be applied by the adjuster to counter-act the outwardly directed pressure when adjusting the flow rate of the nozzle.

19 Claims, 3 Drawing Sheets

U.S. PATENT DOCUMENTS 3,872,928 A * 3/1975 Livingston ..... 169/56
4,095,747 A * 6/1978 Anderson ..... 239/288.5
4,172,559 A 10/1979 Allenbaugh, Jr.
5,215,254 A 6/1993 Haruch
5,261,494 A * 11/1993 McLoughlin et al. ..... 169/70
5,312,048 A * 5/1994 Steingass et al. ..... 239/441
5,390,696 A 2/1995 Bird et al.
5,590,719 A * 1/1997 McLoughlin et al. ..... 169/70
5,964,410 A 10/1999 Brown et al.
6,158,522 A 12/2000 Laderoute
6,425,536 B2 7/2002 Namura
6,598,810 B2 7/2003 Lanteri
7,097,120 B2 8/2006 Marino
7,237,619 B2 7/2007 Mehr
7,258,285 B1 * 8/2007 Combs et al. ..... 239/546
7,284,713 B2 10/2007 Geser et al.
2007/0176022 A1 8/2007 Haiun
2007/0290063 A1 * 12/2007 Combs et al. ..... 239/11

* cited by examiner

SMOOTH BORE NOZZLE WITH ADJUSTABLE BORE

CROSS-REFERENCE TO RELATED APPLICATION

This application claims priority from U.S. Pat. application Ser. 61/013,112, filed Dec. 12,2007, entitled SMOOTH BORE NOZZLE WITH ADJUSTABLE BORE, by Applicant Kyle Alden Stoops, which is incorporated by reference herein in its entirety.

TECHNICAL FIELD AND BACKGROUND OF THE INVENTION

The present invention generally relates to a nozzle and, more particularly, to a nozzle that has a smooth bore that is adjustable.

Smooth bore nozzles are well known in the art and are configured with a gradually diminishing inner diameter from their input end to their discharge or output end to increase fluid flow from a fire hose on which the nozzle is mounted. One disadvantage to smooth bore nozzles is that they typically have a fixed diameter. As a result, they provide a limited flow rate range, with the fluid pressure driving the flow rate change. For example, a one inch diameter smooth bore nozzle will flow approximately 184 gallons per minute at Approximately a 50 psi discharge pressure. However, if the fire hose discharge pressure is increased to 70 psi, the flow rate will increase to approximately 247 gallons per minute.

In order to change the flow rate from a fire hose, the smooth bore nozzle is either replaced with a smooth bore nozzle with a different diameter or a fitting or tip, which is typically threaded onto the nozzle, is added to or removed from the nozzle to change in the inner diameter of the nozzle. For example, when a one inch diameter smooth bore nozzle is substituted with a 1.25 inch diameter smooth bore nozzle, the flow will increase to approximately 326 gallons per minute with the same 50 psi discharge pressure. However, this requires the user to shut off the water supply when changing the nozzle or adding or removing a fitting to change the nozzle diameter. As a result, this can create downtime for the firefighter.

Accordingly, there is a need for a smooth bore nozzle whose flow rate can be adjusted without having to shut off the water flow.

SUMMARY OF THE INVENTION

Accordingly, the present invention provides a nozzle that has an adjustable bore and, therefore, can vary the flow rate through the nozzle without requiring the flow to be shut off. In other words, the present invention provides a nozzle that is adapted to have its bore diameter adjusted while still in a flow condition. The nozzle may be used in a handheld nozzle assembly, in a master stream nozzle, or in a pipe nozzle.

In one form of the invention, an adjustable nozzle includes a nozzle body and a passageway with a central axis and a smooth bore extending between the inlet and the outlet of the nozzle. The inlet is adapted for coupling to a fire suppressant source, such as a fire hose or a pipe. At least a portion of the passageway is defined by a compressible member with an inner dimension transverse to the central axis wherein the inner dimension of the compressible member is adjustable to adjust the flow rate through the nozzle. In addition, the nozzle includes an adjuster to selectively compress the compressible member. When fluid flows through the nozzle, the pressure of the fluid flowing into the nozzle applies an outwardly directed pressure on the compressible member to thereby increase the inner dimension of the compressible member. Further, the nozzle is configured to divert at least a portion of the fluid pressure for applying an inwardly directed pressure on the compressible member to thereby at least reduce the force needed to be applied to the adjuster to counteract the outwardly directed pressure acting on the compressible member when a user is trying to adjust the flow rate of the nozzle.

In one aspect, the nozzle further includes a flexible membrane interiorly of the compressible member, which forms a bladder and defines the passageway.

In another aspect, the compressible member includes a plurality of compressible members. For example, the compressible members may comprise cantilevered beams. In yet a further aspect, the inward pressure is applied to the distal end portions of the cantilevered beams.

According to yet another form of the invention, an adjustable nozzle includes a nozzle body having a longitudinal central axis and a compressible member, which is mounted to the nozzle body. The nozzle body and compressible member have therethrough a passageway, which forms an inlet and an outlet, with the inlet formed at the nozzle body for coupling to a fire suppressant source and the outlet formed at the end of the compressible body portion. The compressible member has an adjustable inner diameter, while the inner diameter of the nozzle body is fixed. In addition, the nozzle includes a tip that is movably mounted to the nozzle body about the compressible member and which is movable along the longitudinal axis and further includes an interface with the compressible member wherein the tip is movable to apply pressure on the compressible member to vary the inner diameter of the compressible member, which is urged outwardly by the fluid pressure of the fluid flowing through the nozzle. In addition, nozzle body includes at least one fluid passage in fluid communication with the fluid passageway through the nozzle body to redirect a portion of the fluid pressure exteriorly of the passageway and further is configured to apply an inward pressure on the compressible member to reduce the force needed to move the tip.

In one aspect, the nozzle may include a flexible membrane that forms a bladder interiorly of the compressible member and which defines a portion of the passageway. In a further aspect, the bladder has an inner diameter and an outer diameter, which is less than the inner diameter of the compressible member when in an unpressurized configuration and when the compressible member is uncompressed but expands to a pressurized configuration in response to fluid pressure in the passageway. When in the pressurized configuration, the bladder is compressible and able to maintain its smooth inner surface to provide the nozzle with an adjustable smooth bore.

In one aspect, the compressible member includes a plurality of spaced longitudinal slots extending along the central axis to form a plurality of beams. In a further aspect, the beams comprise cantilevered beams.

According to a further aspect, the tip comprises a conical-shaped body with a tapered interface with the compressible member. Further, the tapered surface is configured so that when the tip retracts onto the nozzle body, the tip compresses the compressible member.

Accordingly, the present invention provides a smooth bore nozzle with an adjustable diameter so that the flow rate through the nozzle can be achieved during a flow condition and further can be adjusted with greater ease.

These and other objects, advantages, purposes, and features of the invention will become more apparent from the study of the following description taken in conjunction with the drawings.

DETAILED DESCRIPTION OF THE DRAWINGS

DETAILED DESCRIPTION OF THE PREFERRED EMBODIMENTS

Figure 1:
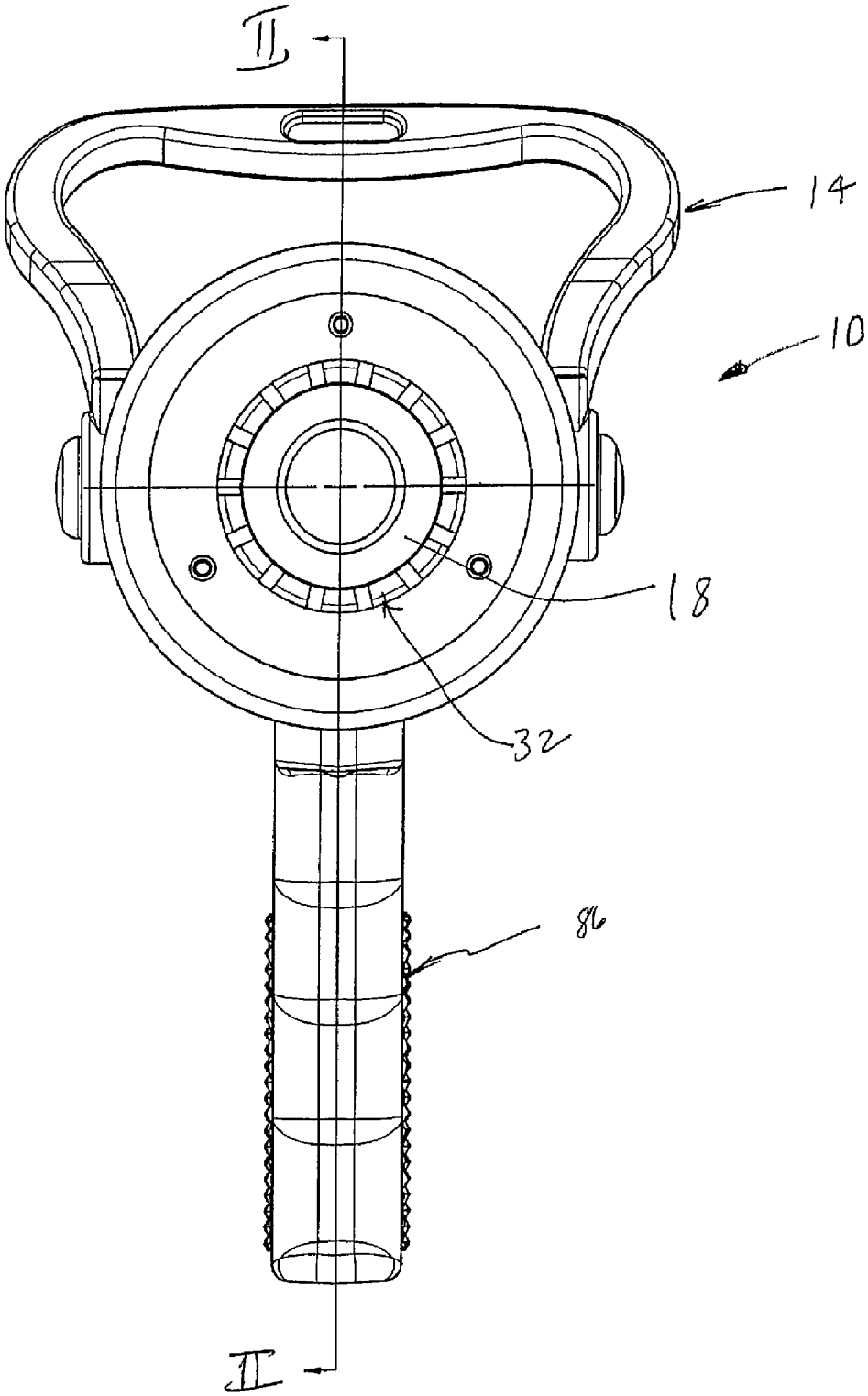
FIG. 1 is an end view of a nozzle of the present invention.

Referring to FIG. 1, the numeral 10 generally designates a nozzle assembly of the present invention. In the illustrated embodiment, nozzle assembly 10 comprises a handheld nozzle assembly, which is adapted for coupling to a fire hose and includes a nozzle 12 and a shut-off valve assembly 14 to open and close the flow of fluid through the nozzle assembly. As will be more fully described below, nozzle assembly 10 is configured to provide an adjustable smooth bore that can be adjusted while a fluid is still flowing through the nozzle assembly. Although illustrated in reference to a handheld nozzle assembly, it should be understood that the principals of this invention may be used in a master stream nozzle for mounting on a monitor or in a pipe nozzle.

Figure 2:
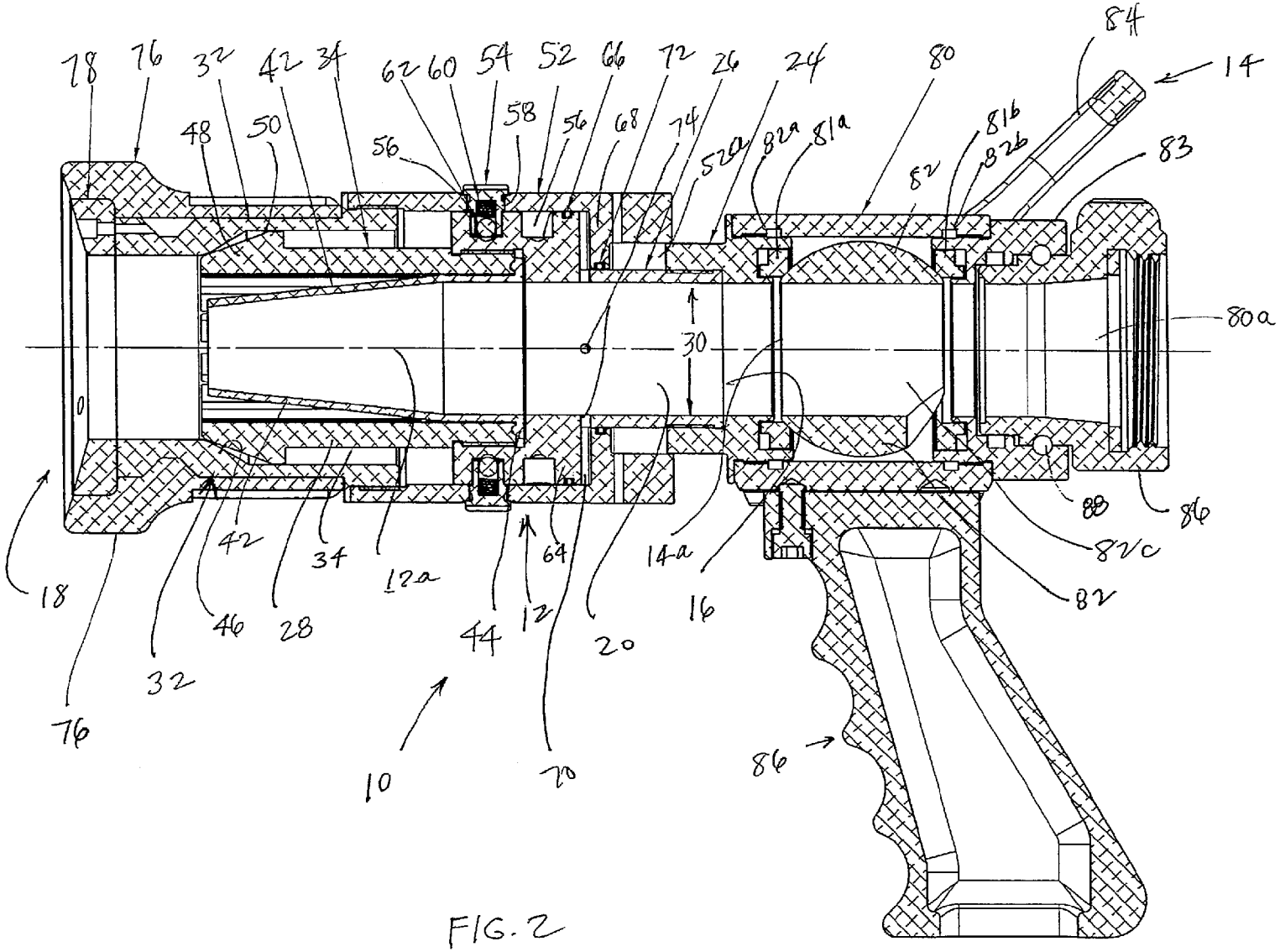
FIG. 2 is a cross-section view taken along line II-II of FIG. 1.

Referring to FIG. 2, nozzle 12 includes an inlet 16, an outlet 18, and a passageway 20 that extends from inlet 16 to outlet 18. Inlet 16 of nozzle 12 is in fluid communication with the outlet 14*a* of shut-off valve assembly 14 through an adapter 24 so that when the shut-off valve assembly is in its open position, fluid will flow through the shut-off valve assembly into nozzle 12 for discharge through outlet 18.

Figure 3:
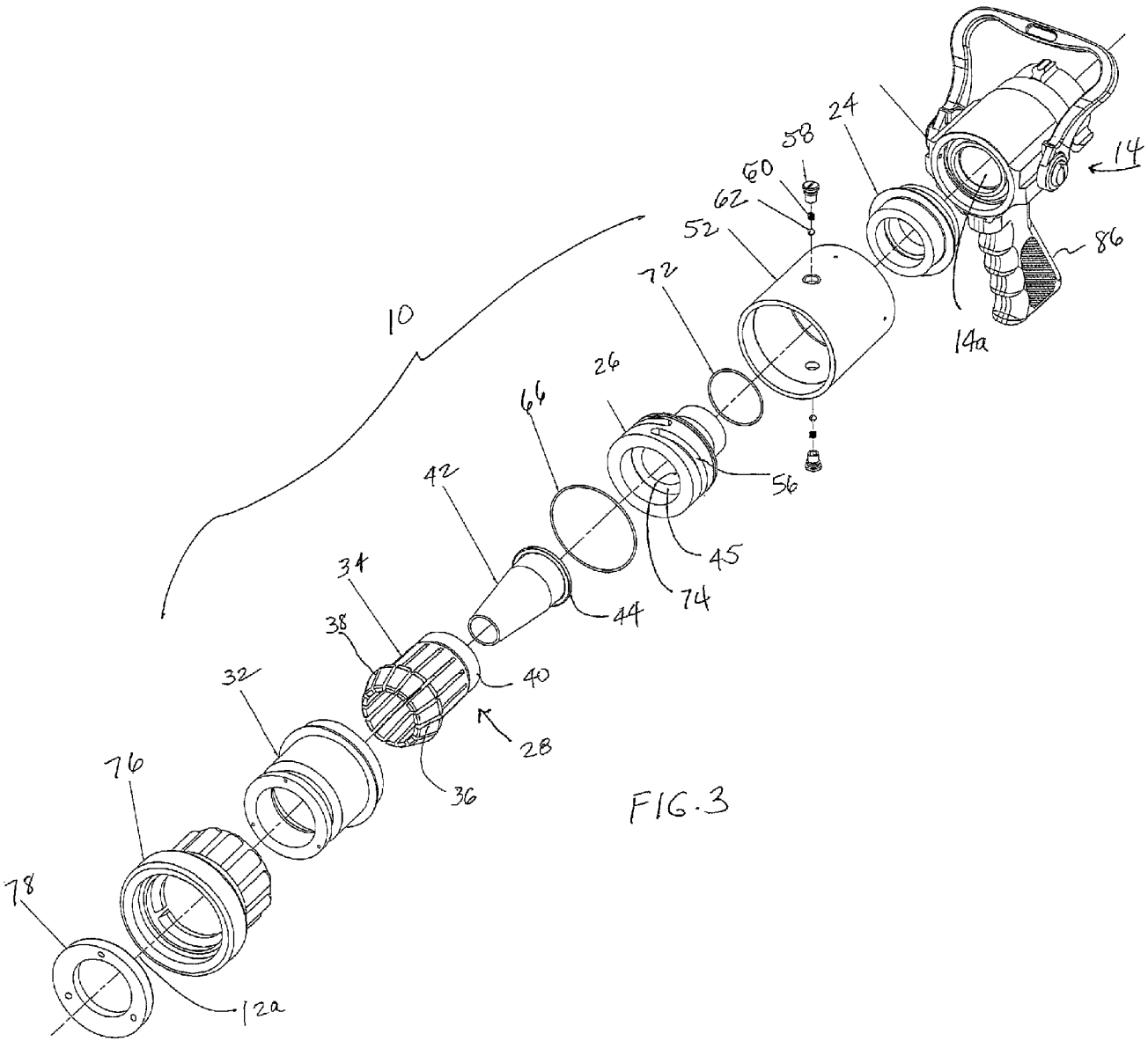
FIG. 3 is an exploded perspective view of the nozzle of the FIG. 1.

As best seen in FIG. 3, nozzle 12 includes a nozzle body 26 and a compressible wall 28, which is mounted to nozzle body 26 and extends from nozzle body 26 to allow adjustment to the flow of fluid through the nozzle. Nozzle body 26 comprises a cylindrical body with a fixed inner diameter 30. In the illustrated embodiment, compressible member 28 comprises a compressible wall that extends from nozzle body 26 along the longitudinal axis 12*a* of nozzle 12 and is configured to expand and contract relative to the longitudinal axis 12*a* in response to the pressure of fluid flowing through nozzle 12 and, further, in response to an external pressure applied by a tip 32, which is movably mounted to nozzle body 26. Furthermore, in the illustrated embodiment, compressible wall 34 includes a plurality of slots 36, which form cantilevered fingers or beams 38, which are cantilevered from a base 40, which secures compressible member to nozzle body. Preferably, slots 36 are aligned and generally parallel to the center line or central axis 12*a* of nozzle 12 and are formed, such as by molding or machining, so that they extend through the entire thickness of the cylindrical wall of cylindrical member 28 to thereby create cantilevered beams 38, which are flexible and act like springs that can be deflected inwardly to reduce the diameter of passageway 20 in the region of compressible member 28. Though described as separate components, it should be understood that compressible member and nozzle body may be formed as a unitary component.

To form a smooth bore through compressible member 28, nozzle 12 also optionally includes a membrane 42, which forms a bladder that extends through the compressible member. To secure membrane 42 to nozzle body, membrane 42 includes an annular rim or skirt, which is capture between an annular shoulder 45 formed on nozzle body 26 and compressible wall 34, which is threaded onto nozzle body 26 (FIG. 2). In this manner, the fluid passageway is formed through nozzle body 26 and membrane 42 with the portion of the passageway 20 formed in bladder 42 inwardly of compressible member 28 having an adjustable diameter.

In addition, to maintain a smooth bore in passageway 20, flexible membrane 42, such as a rubber flexible membrane, is sized such that its outer diameter is inward of the inner diameter of compressible member 28 when compressible member 28 is in an uncompressed condition. However, when membrane 42 is pressurized, membrane 42 will expand to an expanded configuration until the outer diameter is equal to the inner diameter of compressible member 28 when it reaches the inner surface of compressible member 28. In this manner, when compressible member 28 is compressed inwardly, membrane 42 will return to a less expanded configuration, which allows membrane 42 to maintain its smooth walled configuration and, hence, smooth bore and prevent membrane 42 from forming folds or ripples in its wall when compressed. Optionally, a metal sleeve may be positioned between membrane 42 and beams 38 to assure that the membrane 42 does not extrude into the gaps between the beams. For further details of membrane 42 and an optional metal sleeve, reference is made to U.S. Pat. No. 7,258,285, issued Aug. 21, 2007, entitled ADJUSTABLE SMOOTH BORE NOZZLE, and copending application Ser. No. 11/894,089, filed Aug. 20, 2007, entitled ADJUSTABLE SMOOTH BORE NOZZLE, which are incorporated by reference in their entireties herein.

As noted above, compressible member 28 is compressed by the movement of tip 32 relative to longitudinal axis 12*a* of nozzle 12. Tip 32 comprises a generally cylindrical member with a tapered wall, which forms an angled interface surface 46 for compressing compressible member 28. Angled surface 46 contacts the outer ends of compressible member 28 and forms a ramped or cam interface with compressible member 28. In the illustrated embodiment, each beam 38 of compressible member 28 includes a ramped surface 50, which is formed by example by a wedge-shaped end that provides a contact surface for angled surface 46 of tip 32. In this manner, when adjustment tip 32 is retracted along nozzle body 26, angled surface 46 will move along ramp surfaces 50, which will cause beams 38 to compress inwardly when adjustment tip 32 is retracted onto nozzle body 26 but will allow beams 38 to expand radially outward and return to their uncompressed state when adjustment tip 32 is moved to its fully extended position such as shown in FIG. 2. It should be understood that the slope angle of the ramps surfaces and angled surfaces may be varied to increase or decrease the amount of adjustment achieved by a given linear movement of the tip along the nozzle.

In the illustrated embodiment, tip 32 is mounted to nozzle body 26 by an annular member 52, which extends into annular member 52 and is threaded to the inner surface of annular member 52. Annular member 52 is secured to nozzle body by a pair of cam/detent screws 54, which extend through annular member 52 and into a cam groove or slot 56 formed on outer surface of nozzle body 26 (FIG. 3). Each cam/detent screw 54 includes a threaded hollow pin 58, which receives a spring 60, and ball bearing 62 which is urged by spring 60 into engagement with cam slot 56. In this manner, annular member 52 is rotatably mounted about nozzle body 26 while being laterally retained on nozzle body 26 along longitudinal axis 12*a*. Thus, when tip 32 is rotated about longitudinal axis 12*a*, annular member 52 will retract or extend tip 32 along axis 12*a*, which will either compress member 28, and reduce the inner diameter of passageway 20, or will allow compressible member 28 to expand under the force of the fluid flowing through nozzle 12. However, it should be understood that annular member 52 may be secured to the nozzle body with a threaded connection so that annular member 52 is guided along the threads of the threaded connection. Further, annular member 52 may be moved along the nozzle body by an actuator, such as an electric actuator, thus potentially eliminating the need for a cam groove, a slot, or the threaded connection.

Referring again to FIG. 3, cam slot 56 is formed on an enlarged shoulder 64 of nozzle body 26, which is sealed against the inner surface of annular member 52 by a seal 66, such as an o-ring seal (FIG. 2). Further, annular member 52 includes an inwardly extending radial wall 68 to thereby enclose enlarged flange portion 64 of nozzle body 26 and, further, to define a chamber 70 between nozzle body 26 and annular member 52, which will be more fully described below.

In order to reduce the amount of force required to compress compressible wall 28, a portion of the fluid pressure in passageway 20 is redirected exteriorly of passageway 20 and, further, is used to apply an inwardly directed compression force on compressible member 28. In the illustrated embodiment, nozzle body 26 includes one or more fluid passages 74, which are in fluid communication with passageway 20 and, further, in fluid communication with chamber 70. To seal chamber 70, a seal 72, such as an o-ring seal, is positioned between inwardly extending radial wall 68 and nozzle body 26. Thus, when fluid pressure is redirected into chamber 70, the pressure in chamber 70 will apply an axial force on inwardly extending radial wall 68 of annular member 52, which will urge annular member 52 to move to the right as viewed in FIG. 2 and thereby act as a piston. To accommodate the longitudinal movement of annular member 52 relative to the longitudinal axis 12*a* of nozzle 12, annular member 52 includes a recessed annular portion 52*a*, which is sized to receive adapter 24 therein.

As the pressure inside passageway 20 increases, the pressure on annular member 52 will increase. Thus, when an operator wishes to throttle the outlet 18 of nozzle 12, the force required to rotate tip 32 about nozzle body 26 will be reduced by the force due to pressure applied to inwardly extending radial wall 68. Thus, by redirecting a portion of the fluid pressure externally of passage 20, a mechanical advantage is provided to facilitate throttling of the nozzle. In another application, the annular member may be configured to release pressure on the inwardly extending radial wall to increase the diameter of the base.

In the illustrated embodiment, fluid passages 74 comprise circular transverse openings, but it should be understood that passages 74 may also comprise slotted openings or the like. Further, it should be understood that the number and size of the passages may be varied depending, for example, on the size of the nozzle and nozzle bore, and further the desired mechanical advantage.

Optionally, mounted about tip 32 is a bumper 76, such as a rubber bumper, which is secured to tip 32 by a retaining ring 78 and by a plurality of fasteners that extend through retaining ring 78 and into corresponding threaded openings provided in tip 32. Bumper 76 provides a gripping surface for tip and is optionally formed from an elastomeric material, such as rubber, to protect the tip.

As noted above, nozzle 12 is mounted to an on/off valve assembly 14 to control the flow of fluid into the nozzle. As best seen in FIG. 2, shut-off valve assembly 14 includes a valve body 80, which is threaded to adapter 24 and to an inlet adapter 83. Rotatably mounted in adapter 83 is an inlet coupler 86 for securing a hose to shut-off valve assembly 14. In addition, assembly 14 includes a pair of spaced apart valve seats 81*a* and 81*b* mounted in adapters 24 and 83, respectively, and a shut-off ball 82, which is positioned between seats 81*a* and 81*b*. Ball 82 is pivotally mounted in valve body 80 on a shaft (not shown) that is coupled to a handle 84. In this manner, the orientation of shut-off ball 82 may be adjusted by moving handle 84. To seal adapters in valve body 80, seals, such as o-ring seals 82*a* and 82*b*, are positioned between adapters 24 and 83 and valve body 80. Seals are also provided between seats 81*a* and 81*b* and the respective adapters 24 and 83, as well as between coupler 86 and adapter 83. Further, coupler 86 includes a ball race 88, which provides a swivel mount for coupler 86 to adapter 83.

Valve seats 81*a* and 81*b* are respectively positioned adjacent adapters 24 and 83 so that when central passage 82*c* of shut-off ball 82 is aligned between the seats (81*a*, 81*b*), nozzle assembly 10 is opened for flow through the nozzle 12, but when shut-off ball 82 is pivoted by handle 84, shut-off ball 88 will seat against seat 81*a* and close passage 80*a* and, thereby stop the flow into passageway 20.

Further, assembly 10 may also include a handle 86, mounted to shut-off valve assembly 14 to facilitate handling of assembly 10.

As would be understood to those skilled in the art, the present invention provides a nozzle that has a smooth bore with an adjustable inner diameter to provide an adjustable flow rate. With this increase in flexibility, the velocity of a fire hose discharge may be varied without having to replace the nozzle or having to add on to the nozzle; therefore, the adjustment can be achieved while the nozzle is still in a flowing condition and, further, with greater ease.

While several forms of the invention have been shown and described, other forms will now be apparent to those skilled in the art. For example, as noted, nozzle 12 may be incorporated into a pipe nozzle or a master stream nozzle of a monitor. Further, while described in reference to a segmented compressible member, the compressible member may comprise a solid wall with overlapping edges, which allow the wall to compress. In addition, though described in reference to a nozzle that incorporates a bladder, the bladder may be eliminated. Therefore, it will be understood that the embodiments shown in the drawings and described above are merely for illustrative purposes, and are not intended to limit the scope of the invention which is defined by the claims which follow as interpreted under the principles of patent law including the doctrine of equivalents.

The embodiments of the invention in which an exclusive property right or privilege is claimed are defined as follows:

1. A firefighting nozzle comprising:

a nozzle body having a longitudinal central axis, an inlet, and an outlet;

a passageway having a smooth bore extending between said inlet and said outlet;

a compressible member defining at least a portion of said passageway, said compressible member having an inner dimension transverse to the longitudinal central axis; and an adjuster mounted about said compressible member for selectively compressing the compressible member, and wherein the pressure of the fluid flowing into the nozzle applies an outwardly directed pressure on the compressible member to thereby increase the inner dimension of the compressible member, and said nozzle body configured to divert at least a portion of the fluid pressure from said passageway exteriorly of said nozzle body for applying an inwardly directed pressure on the compressible member to thereby at least reduce the force needed to be applied by the adjuster to counter-act the outwardly directed pressure when adjusting the flow rate of the nozzle.

2. The adjustable nozzle according to claim 1, wherein said compressible member comprises a plurality of compressible members.

3. The adjustable nozzle according to claim 2, wherein each of said compressible members comprises a cantilevered beam.

4. The adjustable nozzle according to claim 3, wherein each of said cantilevered beams has a distal end portion, the inwardly directed pressure on the compressible member being applied to said distal end portions.

5. The adjustable nozzle according to claim 1, further comprising a bladder positioned inwardly of said compressible member and defining said passageway, said compressible member compressing said bladder when inwardly directed pressure is applied to said compressible member.

6. The adjustable nozzle according to claim 1, further comprising an annular piston extending around said compressible member and being movable along said longitudinal central axis, the diverted fluid pressure applying pressure on said piston, and said piston applying the inwardly directed pressure on said compressible member.

7. The adjustable nozzle according to claim 6, wherein said compressible member includes a wedge-shaped distal end portion, wherein linear travel of said piston along said longitudinal central axis either applies a compression force on said compressible member or allows said compressible member to expand under the force of the fluid pressure flowing through the nozzle.

8. The adjustable nozzle according to claim 7, wherein said piston is guided along said nozzle body by a cam groove.

9. The adjustable nozzle according to claim 8, wherein said nozzle body includes said cam groove.

10. The adjustable nozzle according to claim 8, wherein said nozzle body includes a nozzle body wall and a plurality of transverse fluid passages through said nozzle body wall, said transverse fluid passages for diverting at least a portion of the fluid pressure from the inlet for applying an inwardly directed pressure on the compressible member.

11. The adjustable nozzle according to claim 10, wherein said fluid passages comprise transverse openings in said body wall of said nozzle body.

12. The adjustable nozzle according to claim 1, further comprising a shut-off valve assembly.

13. The adjustable nozzle according to claim 1, further comprising a chamber between said adjuster and said outside surface of said nozzle body, wherein said nozzle body includes a transverse opening providing fluid communication between said passageway and said chamber wherein said transverse opening redirects fluid pressure from said passageway to said chamber exteriorly of said nozzle body, and said chamber, when pressurized with the diverted fluid pressure, reducing the force needed to be applied to the adjuster to counteract the outwardly directed pressure when adjusting the flow rate of the nozzle.

14. An adjustable nozzle comprising:

a nozzle body having a longitudinal central axis and a fixed inner diameter;

a compressible member mounted to the nozzle body;

the nozzle body and compressible member having there through a passageway forming an inlet and an outlet, the inlet being formed at the nozzle body for coupling to a fire suppressant source and the outlet being formed at the end of the compressible member; the compressible member having an adjustable inner diameter;

a tip movably mounted to the nozzle body about the compressible member and being movable along the longitudinal axis and further including an interface with the compressible member wherein the tip is movable to vary the compression on the compressible member to vary the inner diameter of the compressible member, which is urged outwardly by the fluid pressure of the fluid flowing through the nozzle; and the nozzle body including at least one fluid passage in fluid communication with the fluid passageway through the nozzle body to redirect a portion of the fluid pressure exteriorly of the passageway and further being configured to use the redirected portion of the fluid pressure to apply or reduce pressure on the compressible member to change the force needed to move the tip.

15. The adjustable nozzle according to claim 14, wherein said further the tip comprises a conical-shaped body with a tapered interface with the compressible member.

16. The adjustable nozzle according to claim 15, wherein the tapered surface is configured so that when the tip retracts onto the nozzle body, the tip compresses the compressible member.

17. The adjustable nozzle according to claim 14, further comprising a flexible membrane forming a bladder interiorly of the compressible member and defining a portion of the passageway.

18. The adjustable nozzle according to claim 17, wherein the bladder has an inner diameter and an outer diameter less than the inner diameter of the compressible member when in an unpressurized configuration and when the compressible member is uncompressed but expands to a pressurized configuration in response to fluid pressure in the passageway whereby in the pressurized configuration, the bladder is compressible and able to maintain its smooth inner surface to provide the nozzle with an adjustable smooth bore.

19. The adjustable nozzle according to claim 14, wherein the compressible member includes a plurality of spaced longitudinal slots extending along the central axis.

* * * * *